US007102507B1

(12) United States Patent
Lauren

(10) Patent No.: US 7,102,507 B1
(45) Date of Patent: Sep. 5, 2006

(54) KEYLESS ENTRY SYSTEM

(76) Inventor: Givi Lauren, 104-40 Queens Blvd., Apt. 17J, Forest Hills, NY (US) 11375

( * ) Notice: Subject to any disclaimer, the term of this patent is extended or adjusted under 35 U.S.C. 154(b) by 124 days.

(21) Appl. No.: 10/896,183

(22) Filed: Jul. 21, 2004

(51) Int. Cl.
*G08B 1/08* (2006.01)
*G08C 19/00* (2006.01)

(52) U.S. Cl. ..... 340/539.11; 340/539.32; 340/825.69; 341/22; 341/176

(58) Field of Classification Search ..... 340/539.11, 340/539.32
See application file for complete search history.

(56) References Cited

U.S. PATENT DOCUMENTS

| | | | | |
|---|---|---|---|---|
| 4,931,789 | A * | 6/1990 | Pinnow | 340/5.64 |
| 5,438,315 | A | 8/1995 | Nix | 340/539.11 |
| 5,608,389 | A * | 3/1997 | Matsuzawa | 340/825.57 |
| 5,627,529 | A | 5/1997 | Duckworth et al. | 340/825.69 |
| 5,678,436 | A | 10/1997 | Alexander | 70/278.3 |
| 5,705,997 | A * | 1/1998 | Park | 340/825.49 |
| 5,929,769 | A * | 7/1999 | Garnault | 340/5.61 |
| 6,043,753 | A | 3/2000 | Okayashu et al. | 340/5.26 |
| 6,081,194 | A | 6/2000 | Sanchez | 340/573.1 |
| 6,131,019 | A | 10/2000 | King | 455/99 |
| 6,244,084 | B1 | 6/2001 | Warmack | 70/278.1 |
| D445,707 | S | 7/2001 | Zakhakyan | D10/104 |
| 6,282,152 | B1 * | 8/2001 | Kurple | 368/10 |
| 6,774,787 | B1 * | 8/2004 | Melbourne | 340/539.1 |
| 2002/0171559 | A1 * | 11/2002 | Yang | 340/825.69 |
| 2004/0227642 | A1 * | 11/2004 | Giles et al. | 340/825.72 |

* cited by examiner

*Primary Examiner*—Donnie L. Crosland
(74) *Attorney, Agent, or Firm*—Bernard S. Hoffman

(57) ABSTRACT

A device for wearing on the wrist of a user and being capable of operating multiple remote controlled devices. The device includes a band, a remote control transmitter, and a plurality of buttons. The band is worn around the wrist of a user. The remote control transmitter is disposed at the band and selectively transmits different signals. Each signal selectively transmitted by the remote control transmitter is received by a specific receiver operatively connected to a remote controlled device, and when the specific receiver receives an associated signal, the remote controlled device operatively connect thereto operates. The plurality of buttons are disposed at the band and are operatively connected to the remote control transmitter. Each button is associated with a specific signal so as to allow the specific signal to be transmitted when an associated button is activated.

13 Claims, 5 Drawing Sheets

KEYLESS ENTRY SYSTEM

BACKGROUND OF THE INVENTION

1. Field of the Invention

The present invention relates to a bracelet, and more particularly, the present invention relates to a multiple remote control capable bracelet.

2. Description of the Prior Art

Remote control is not a new idea in modern society. In fact, most people have several remote controls for different objects. The problem is with convenience and size. Multiple remote controls and their bulky shape prevent a user from quickly operating a variety of devices.

An example of a vehicle control system is Duckworth, U.S. Pat. No. 5,627,529. However this is strictly limited to automobiles.

Additionally, another example of the prior art is Alexander, U.S. Pat. No. 5,678,436. This deals with the actual unlocking of the door and does not open a variety of other items.

BRIEF SUMMARY OF THE INVENTION

Thus, an object of the present invention is to provide a multiple remote control capable bracelet that avoids the disadvantages of the prior art.

Briefly stated, another object of the present invention is to provide a device for wearing on the wrist of a user and being capable of operating multiple remote controlled devices. The device includes a band, a remote control transmitter, and a plurality of buttons. The band is worn around the wrist of a user. The remote control transmitter is disposed at the band and selectively transmits different signals. Each signal selectively transmitted by the remote control transmitter is received by a specific receiver operatively connected to a remote controlled device, and when the specific receiver receives an associated signal, the remote controlled device operatively connect thereto operates. The plurality of buttons are disposed at the band and are operatively connected to the remote control transmitter. Each button is associated with a specific signal so as to allow the specific signal to be transmitted when an associated button is activated.

LIST OF REFERENCE NUMERALS UTILIZED IN THE DRAWINGS

Figure 1:
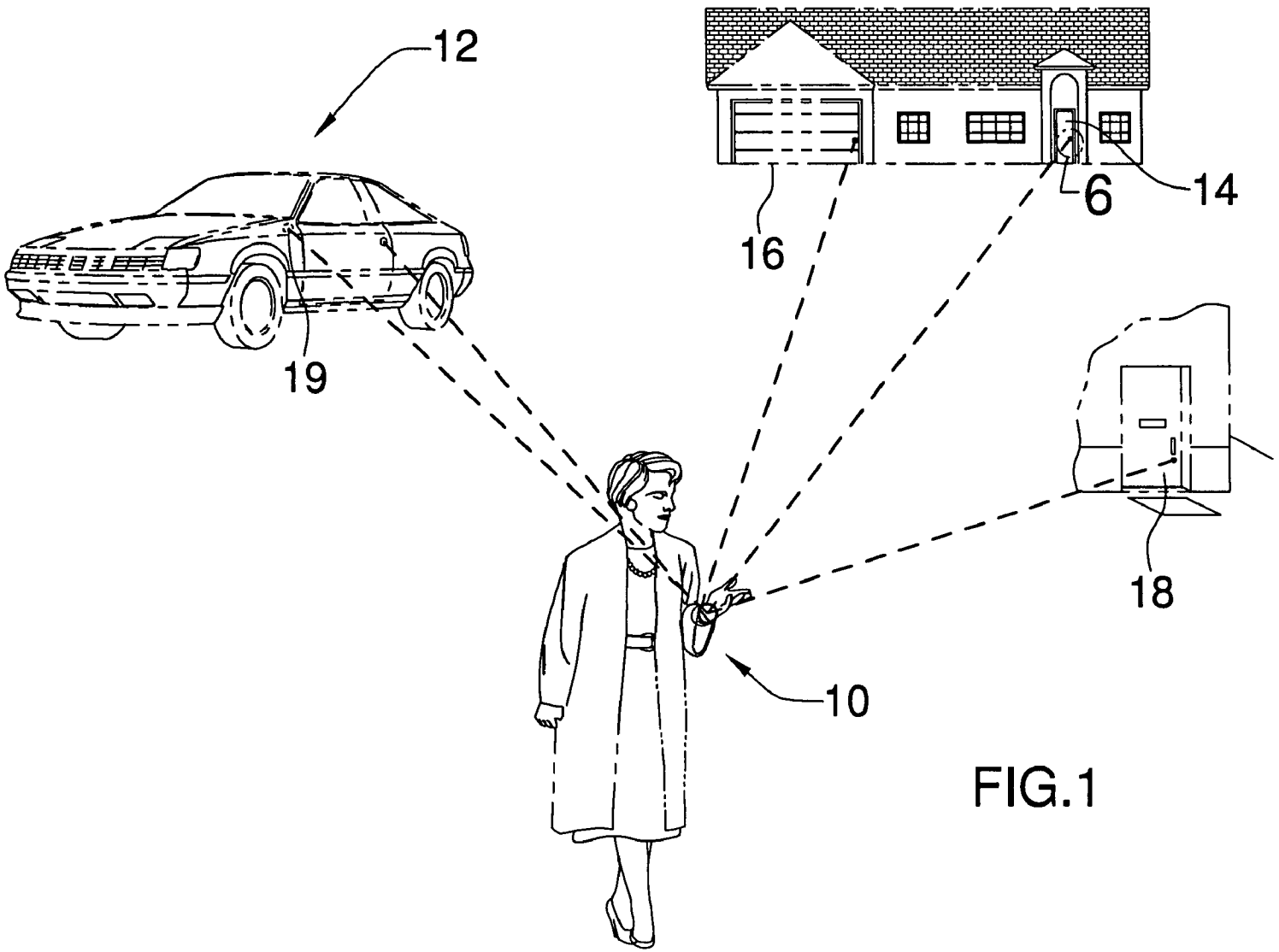
FIG. 1 is a representation of the multiple remote control capable bracelet of the present invention in use with various entry ports.

10 multiple remote control capable bracelet
12 car
14 house door

16 garage door
18 back door
19 car alarm
26 piece of elastic material
20 button to unlock particular ports of entry
22 button to lock particular ports of entry
24 night light switch
28 size adjusting device
30 dead bolt of door
32 door handle

DETAILED DESCRIPTION OF THE PREFERRED EMBODIMENT

The multiple remote control capable bracelet 10 generally surrounds an individual's wrist. An adjustment can be made as far as a specific dimension of a particular wrist to fit comfortably and to not slip off a hand.

The multiple remote control capable bracelet 10 can be equipped to open a car 12, a garage door 16, a house door 14, and a back door 18. These are just representative examples of some items that may be opened or deactivated. It may also activate and deactivate a car alarm 19. FIG. 1

Figure 2:
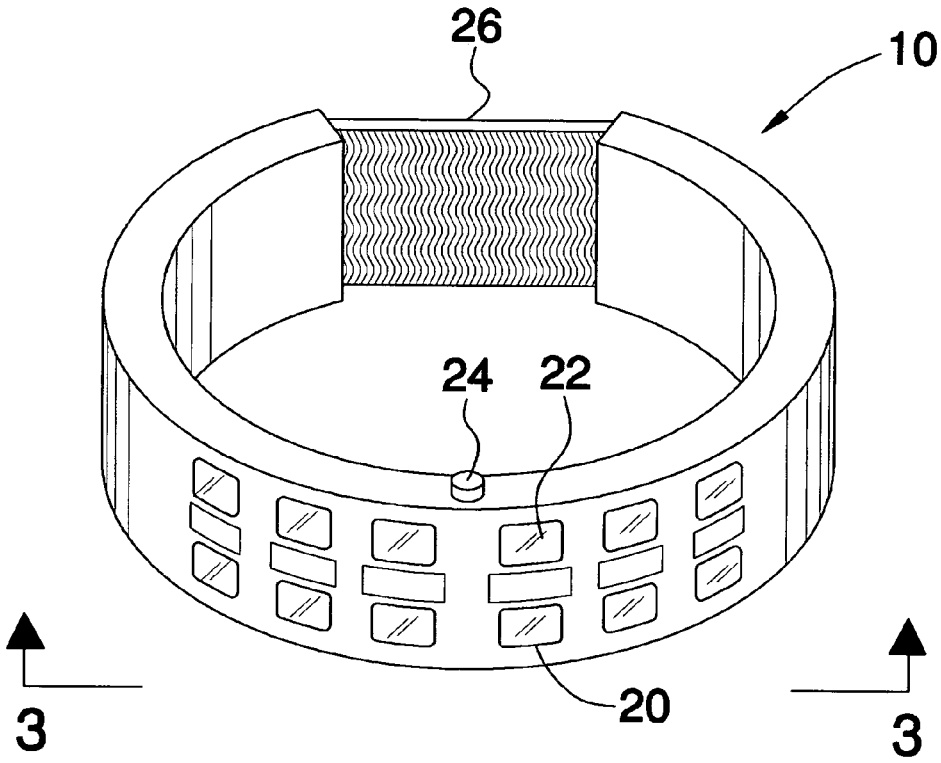
FIG. 2 is a diagrammatic perspective view of the multiple remote control capable bracelet of the present invention.
Figure 4:
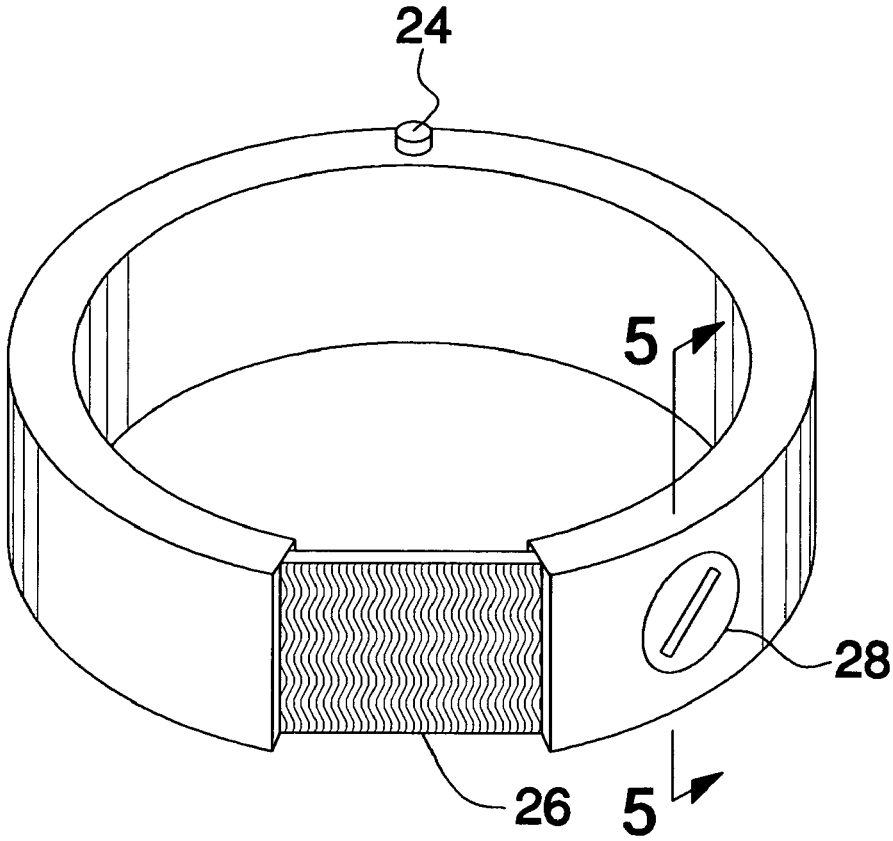
FIG. 4 is a diagrammatic back perspective view of the multiple remote control capable bracelet of the present invention.

FIGS. 2 and 4 depict the multiple remote control capable bracelet 10 in a perspective, as well as a front view. The multiple remote control capable bracelet 10 comprises an essentially annular shaped, outside plastic covering having a piece of elastic material 26 to adjust for the wrist of the individual. A plurality of buttons are disposed on a front portion of the multiple remote control capable bracelet 10, opposite to the elastic material 26. The multiple remote control capable bracelet 10 can have a button to unlock 20 and a button to lock 22 particular ports of entry.

Figure 3:
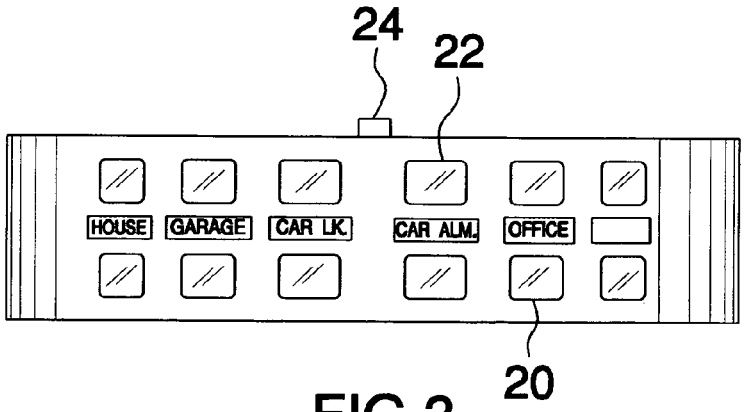
FIG. 3 is a diagrammatic view of the multiple remote control capable bracelet of the present invention with examples of items that may be opened or closed.

FIG. 3 depicts typical representative examples of those items that may be opened or closed with the multiple remote control capable bracelet 10.

In addition, there is a night light switch 24 that will illuminate the multiple remote control capable bracelet 10 in dimly lit areas or at night.

FIG. 4 is a back view of the multiple remote control capable bracelet 10 which shows the elastic material 26, the night light 24, as well as a size adjusting device 28. The size adjusting device 28 is merely to adjust the width of the multiple remote control capable bracelet 10 for comfort for the individual.

Figure 5:
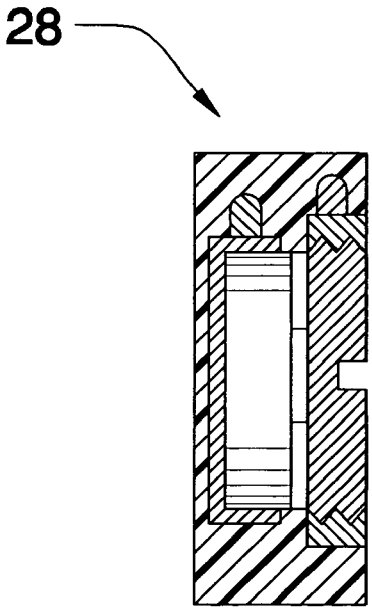
FIG. 5 is a diagrammatic cross sectional view of the locking mechanism taken along line 5—5 in FIG. 4.

FIG. 5 is a presentation of a cross section of the size adjusting device on the multiple remote control capable bracelet 10. As it is turned to the right, the bracelet tightens. It becomes looser when turned to the left.

Figure 6:
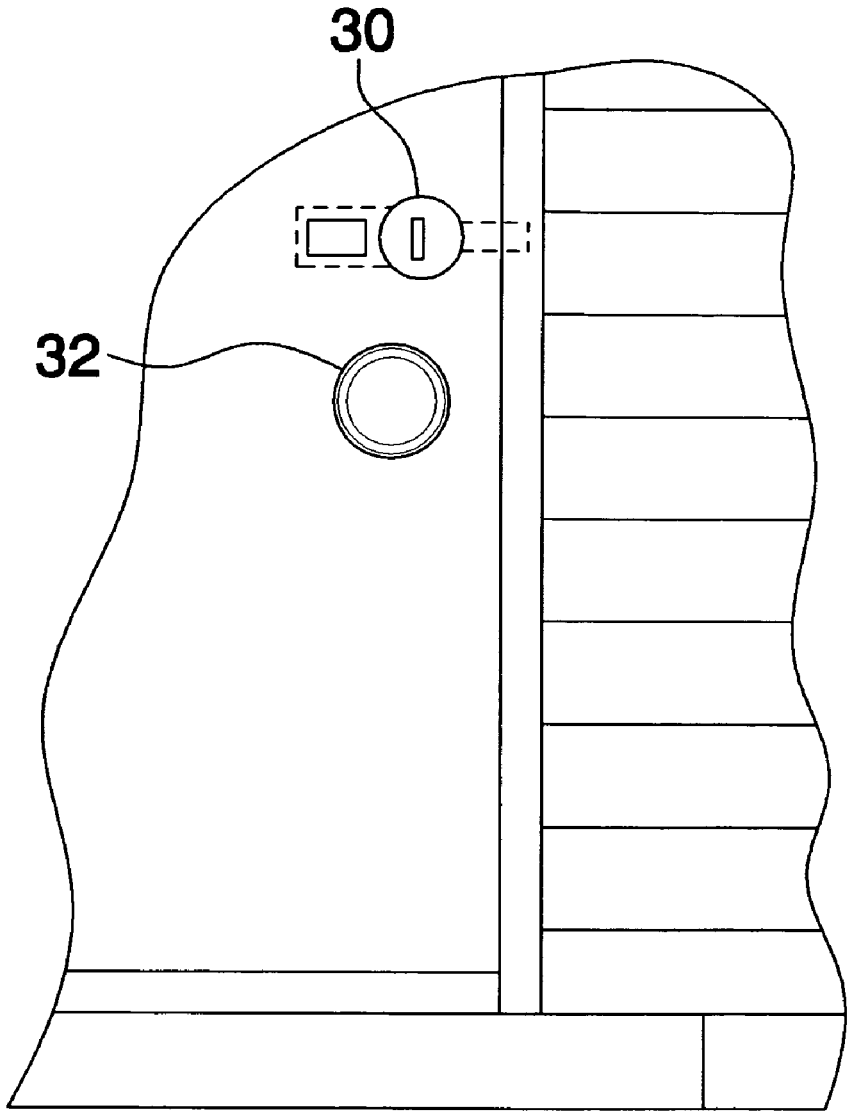
FIG. 6 is a diagrammatic representation of a door lock as depicted in FIG. 1.

FIG. 6 represents a dead bolt 30 of a door, as well as a door handle 32.

As the multiple remote control capable bracelet 10 is activated, the dead bolt 30 will either unlock or lock remotely by use of a radio frequency.

Figure 7:
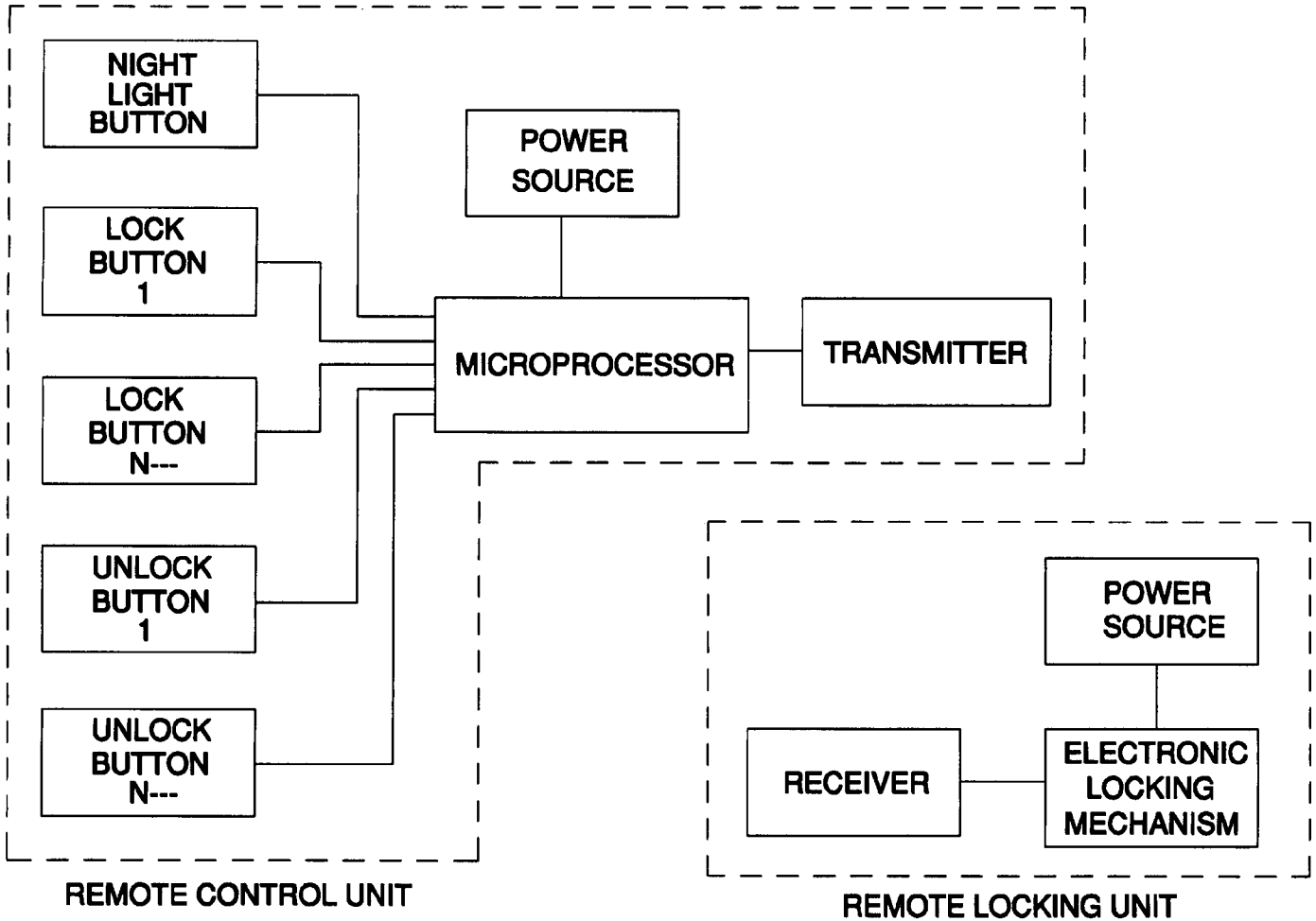
FIG. 7 is a schematic of the multiple remote control capable bracelet of the present invention.

FIG. 7 is a schematic of the multiple remote control capable bracelet 10. Again, the multiple remote control capable bracelet 10 can be used in a variety of other applications and can be programmed so that multiple items can be activated or deactivated. A transmitter sends a radio frequency to a receiver, which then activates a lock to perform a desired function.

It is contemplated that the buttons could be color-coded for easier use and may be offered in a variety of styles. Also, for blind users, the buttons could be equipped with braille symbols.

The multiple remote control capable bracelet 10 can be made to be waterproof, lightweight, aesthetically pleasing, and elegant. It is also thought that a cover may be offered so as to hid the multiple remote control capable bracelet 10 when in use. The multiple remote control capable bracelet 10 eliminates a problem of fumbling for a key and would help to prevent loss or misplacement of a key.

The multiple remote control capable bracelet 10 can be operated to open a variety of locks in houses, cars, stores, and even gym lockers.

While the embodiments of the invention have been disclosed, certain modifications may be made by those skilled in the art to modify the invention without departing from the spirit of the invention.

The invention claimed is:

1. A device for wearing on the wrist of a user and being capable of operating multiple remote controlled devices, comprising:

a) a band;

b) a remote control transmitter; and c) a plurality of buttons;

wherein said band is for wearing around the wrist of a user;

wherein said remote control transmitter is disposed at said band;

wherein said remote control transmitter selectively transmits different signals;

wherein each signal selectively transmitted by said remote control transmitter is for being received by a specific receiver operatively connected to a remote controlled device, and when the specific receiver receives an associated signal, the remote controlled device operatively connected thereto operates;

wherein said plurality of buttons are disposed on said band;

wherein said plurality of buttons are operatively connected to said remote control transmitter;

wherein each button is associated with a specific signal so as to allow said specific signal to be transmitted when an associated button is activated, thereby allowing different remote controls devices to be activated when an associated button is activated; and wherein said radio control transmitter is programmable to selectively transmit said different signals, thereby allowing the remote controlled devices that said buttons control to be changed as the need arises without having to change said band.

2. The band of claim 1, further comprising a night light switch;

wherein said night light switch is disposed on said band; and wherein said night light switch illuminates said device in dimly lit areas or at night.

3. The device of claim 1, further comprising an adjustable strap;

wherein said adjustable strap forms a part of said band for allowing for length adjustment of said band for comfort of the user.

4. The device of claim 3, wherein said adjustable strap is operational while said band is on the wrist of the user.

5. The device as described in claim 1, wherein said signals are radio frequency signals.

6. The device of claim 1, wherein said plurality of buttons are color-coded to identify particular functions.

7. The device of claim 1, wherein said plurality of buttons are equipped with braille characters for identification by the user who is blind.

8. The device of claim 1, wherein said device is waterproof.

9. The device of claim 1, further comprising a cover; and wherein said cover conceals said device when in use.

10. The device of claim 1, wherein said band is made of plastic.

11. The device of claim 3, wherein said adjustable strap is made of a piece of elastic material.

12. The device of claim 3, wherein said band has a back portion; and wherein said adjustable strap is disposed at said back portion of said band.

13. The device as defined in claim 12, wherein said band has a front portion;

wherein said front portion of said band is opposite to said back portion of said band; and wherein said plurality of buttons are disposed on said front portion of said band.

* * * * *